US005427035A

United States Patent [19]

Grahl

[11] Patent Number: 5,427,035

[45] Date of Patent: Jun. 27, 1995

[54] HEIGHT-ADJUSTABLE TABLE

[75] Inventor: Friedrich W. Grahl, Steyerberg/Voigtei, Germany

[73] Assignee: Grahl GmbH, Steyerberg, Germany

[21] Appl. No.: 138,478

[22] Filed: Oct. 15, 1993

[30] Foreign Application Priority Data

Oct. 15, 1992 [DE] Germany ..... 9213927 U

[51] Int. Cl.[6] ..... A47B 9/00

[52] U.S. Cl. ..... 108/144; 108/146

[58] Field of Search ..... 108/147, 144, 146, 148; 248/188.5

[56] References Cited

U.S. PATENT DOCUMENTS 2,875,007 2/1959 Fox ..... 248/188.5
3,410,232 11/1968 Krueger ..... 108/146
3,523,702 8/1970 Unti et al. .
3,855,946 12/1974 Bales .
3,915,102 10/1975 Barron ..... 108/146 X
4,515,087 5/1985 Kurrasch ..... 108/147
5,107,775 4/1992 Langlais et al. .

FOREIGN PATENT DOCUMENTS 0405157 1/1991 European Pat. Off. .

*Primary Examiner*—Jose V. Chen
*Attorney, Agent, or Firm*—Robert W. Becker & Associates

[57] ABSTRACT

A height-adjustable table, especially a desk, has at least one table leg including two vertically extending outer tubular elements connected by a central stay in which inner tubular elements are telescopically guided. The inner tubular elements of the table leg can be adjusted together and clamped relative to the outer tubular elements with an arresting and clamping mechanism at different heights.

6 Claims, 2 Drawing Sheets

HEIGHT-ADJUSTABLE TABLE

BACKGROUND OF THE INVENTION

The present invention relates to a height-adjustable table, especially a desk, with at least one table leg.

With tables, especially desks, it is desirable for ergonomic reasons to adjust the table top height to the size of the person working at the desk or table. For this purpose, it is conventional, for example, to employ telescope-type table legs that are continuously adjustable or stepwise adjustable in their height.

It is an object of the present invention to provide a table leg with two vertical supports such that the vertical supports are together and simultaneously adjustable in their height depending on the size of the person working at the table.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
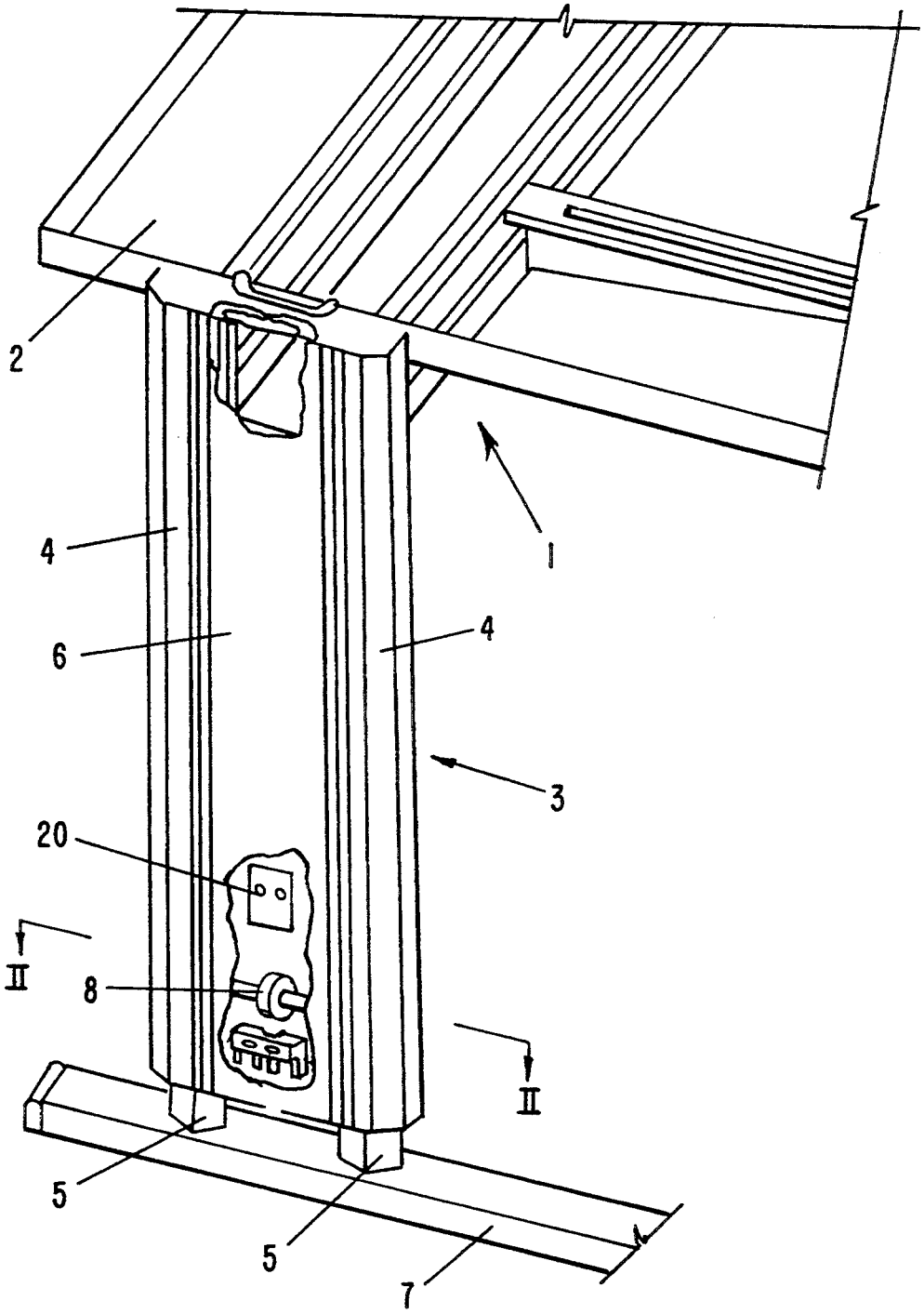
FIG. 1 shows an isometric representation of a part of the inventive table with the respective table leg.

The height-adjustable table of the present invention is primarily characterized by:

A table top;

At least one leg connected to the table top;

The leg having two vertical outer tubular elements connected by a stay and two vertical inner tubular elements positioned within the outer tubular elements so as to be telescopically displaceable within the outer tubular elements; and The leg further having an arresting and clamping mechanism for adjusting and arresting a position of the inner tubular elements relative to the outer tubular elements.

Preferably, the height-adjustable table further comprises a horizontal support connected to a bottom end of the inner tubular elements, wherein the inner tubular elements are secured against rotation within the outer tubular elements and are telescopically displaceable in a downward direction relative to the outer tubular elements.

Expediently, the arresting and clamping mechanism is positioned within an area of the stay and comprises two arresting and clamping lugs and a common actuating member for simultaneously adjusting in a direction to and from the outer and inner tubular elements the arresting and clamping lugs.

In a preferred embodiment of the present invention, the arresting and clamping mechanism further comprises two first threaded elements and two second threaded elements, the second threaded elements cooperating with the first threaded elements. The first threaded elements are connected to opposite sides of the actuating member. One of the first threaded elements has a left-hand thread and the other of the first threaded elements has a right-hand thread. The arresting and clamping lugs are connected to the second threaded elements.

Preferably, the first threaded elements are threaded bolts and the second threaded elements are threaded sleeves to which the arresting and clamping lugs facing outwardly toward the outer tubular elements are connected.

Expediently, the second threaded elements are secured against rotation.

Preferably, each inner tubular element has openings spaced vertically from one another for receiving the arresting and clamping lugs. Preferably, the arresting and clamping lugs taper conically in an outward direction.

According to the present invention, the height-adjustable table has table leg with two vertical outer tubular elements connected by a central stay in which outer tubular elements inner tubular elements are guided in a telescopic manner, the inner tubular elements adjustable to and arrestable at different heights relative to the outer tubular elements by an arresting and clamping mechanism. The arresting and clamping mechanism is preferably arranged within the area of the central stay and comprises two adjustable arresting and clamping lugs which are together and simultaneously outwardly displaceable with an actuating member toward the outer and inner tubular elements. The arresting and clamping lugs are secured against rotation and their outer conically tapering ends are insertable into openings provided at the oppositely arranged inner tubular elements and vertically spaced at a certain distance from one another.

DESCRIPTION OF PREFERRED EMBODIMENTS

Figure 2:
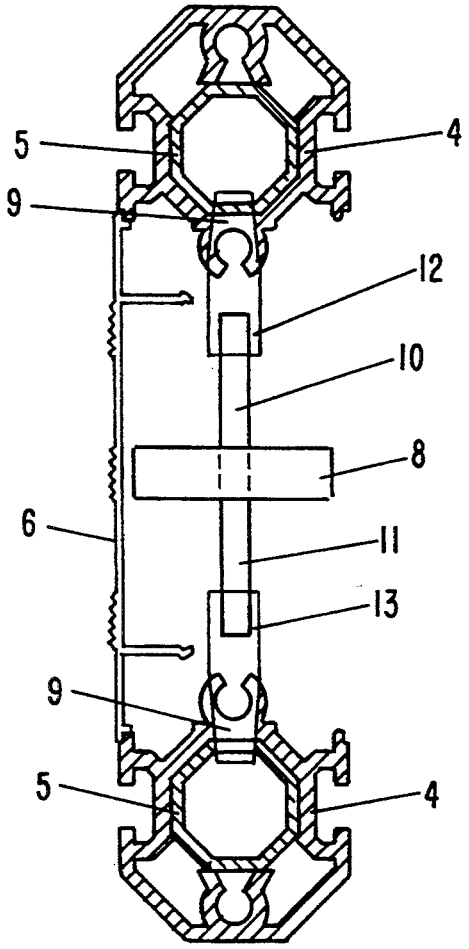
FIG. 2 shows a sectional view according to line II—II of the table leg with tubular elements arrested and clamped relative to one another.
Figure 3:
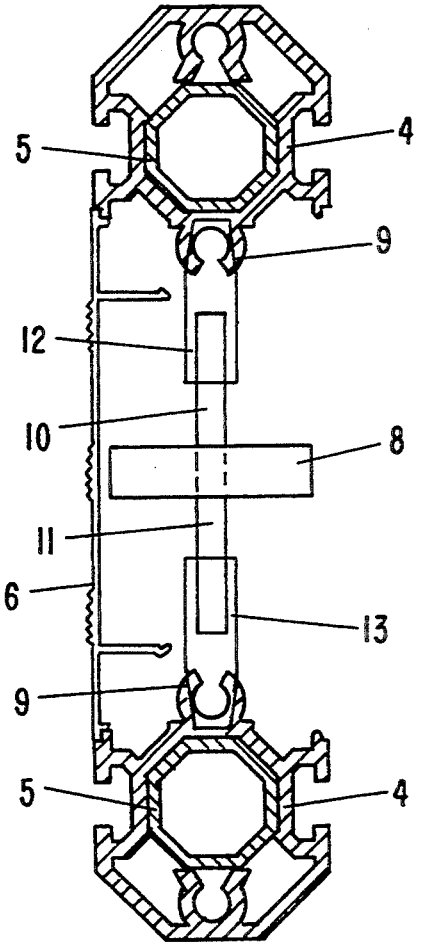
FIG. 3 shows a sectional view along line II—II of FIG. 1 at the moment of adjustment of the tubular elements relative to one another.

The present invention will now be described in detail with the aid of a specific embodiment utilizing FIGS. 1 through 3.

FIG. 1 shows a table, especially a desk 1, with an upper table top 2 and one of two table legs 3. The individual table leg 3 is comprised of outer tubular elements 4 which are spaced apart at a distance and in which two inner tubular elements 5 are telescopically guided. The two outer tubular elements 4 are connected to one another by a central stay 20 which extends over a portion of the height of the table leg so that the two outer tubular elements together with the central stay form a rigid unit. To the outer sides, respectively, the outer mantle surface of the outer tubular elements vertically extending facers 6 are connected, with only one being shown in FIGS. 2 and 3.

The inner tubular elements 5 which are telescopically extendable from the bottom end of the outer tubular elements 4 are connected to a common horizontal support 7. Between the two outer tubular elements 4, substantially within the area of the central stay 20 between the two facers 6, an arresting and clamping mechanism is arranged which comprises two arresting and clamping lugs 9 that are simultaneously outwardly displaceable in direction toward the outer and inner tubular elements 4, 5 by an actuating member 8.

These arresting and clamping lugs 9 which taper conically toward their free ends are insertable into openings of the inner tubular elements 5 which are spaced from one another at a vertical distance. For this purpose, the actuating member 8, preferably in the form of knurled wheel, is provided with two oppositely oriented first threaded elements in the form of threaded bolts 10, 11 one of which having a right-hand thread and the other having a left-hand thread. These two threaded bolts 10, 11 cooperate with two corresponding threaded elements in the form of threaded nuts or threaded sleeves 12, 13 to which the outwardly oriented arresting and clamping lugs 9 are connected. By rotating the knurled wheel 8 in one direction the two threaded sleeves 12, 13, secured against rotation, can be extended outwardly into the corresponding openings of the inner tubular elements 5, while by rotating the knurled wheel in the opposite direction the two arresting and clamping lugs 9 can be displaced inwardly until the inner tubular elements 5 can be moved relative to the outer tubular elements 4.

The inner and outer tubular elements 4, 5 are preferably provided with guide elements which prevent a rotation of the two elements relative to one another. According to the representation in the drawings the outer and inner tubular elements have, for example, an octagonal cross-section.

The present invention is, of course, in no way restricted to the specific disclosure of the specification and drawings, but also encompasses any modifications within the scope of the appended claims.

What I claim is:

1. A height-adjustable table comprising:

a table top;

at least one leg connected to said table top;

said leg having two vertical outer tubular elements connected by a stay and two vertical inner tubular elements positioned within said outer tubular elements so as to be telescopically displaceable in a downward direction relative to said outer tubular elements;

said leg further having an arresting and clamping mechanism for adjusting and arresting a position of said inner tubular elements relative to said outer tubular elements:

a horizontal support connected to a bottom end of said inner tubular elements;

said arresting and clamping mechanism positioned within an area of said stay and comprising two arresting and clamping lugs and a common actuating member for simultaneously adjusting in opposite directions perpendicular to said vertically extending outer and inner tubular elements said arresting and clamping lugs;

said arresting and clamping mechanism further comprising two first threaded elements and two second threaded elements, said second threaded elements cooperating with said first threaded elements;

said first threaded elements connected to opposite sides of said actuating member;

one said first threaded element having a left-hand thread and the other said first threaded element having a right-hand thread; and said arresting and clamping lugs connected to said second threaded elements so as to be displaced in a linear direction of threading of said second threaded elements.

2. A height-adjustable table according to claim 1, wherein said inner tubular elements are secured against rotation within said outer tubular elements.

3. A height-adjustable table according to claim 1, wherein said first threaded elements are threaded bolts and wherein said second threaded elements are threaded sleeves to which said arresting and clamping lugs, facing outwardly toward said outer tubular elements, are connected.

4. A height-adjustable table according to claim 1, wherein said second threaded elements are secured against rotation.

5. A height-adjustable table according to claim 1, wherein each said inner tubular element has openings spaced vertically from one another for receiving said arresting and clamping lugs.

6. A height-adjustable table according to claim 5, wherein said arresting and clamping lugs taper conically in an outward direction.

* * * * *